United States Patent [19]

Kaneda et al.

[11] 3,932,189

[45] Jan. 13, 1976

[54] THERMODEVELOPABLE PHOTOGRAPHIC MATERIAL CONTAINING HIGH SILVER ION CONDUCTING SUBSTANCE

[75] Inventors: Takuji Kaneda; Makoto Nagao; Satoru Honjo; Eiichi Mizuki, all of Asaka, Japan

[73] Assignee: Fuji Photo Film Co., Ltd., Minami-ashigara, Japan

[22] Filed: Jan. 10, 1974

[21] Appl. No.: 432,252

[30] Foreign Application Priority Data

Jan. 12, 1973 Japan ..... 48-6402

[52] U.S. Cl. ..... 96/114.6; 96/48 HD; 96/114.1

[51] Int. Cl.[2] ..... G03C 1/02

[58] Field of Search ..... 96/114.6, 114.1, 48 HD, 96/67

[56] References Cited

UNITED STATES PATENTS 3,457,075 7/1969 Morgan et al. ..... 96/67

*Primary Examiner*—David Klein
*Assistant Examiner*—Alfonso T. Suro Pico
*Attorney, Agent, or Firm*—Sughrue, Rothwell, Mion, Zinn & Macpeak

[57] ABSTRACT

A thermodevelopable photographic material comprising a support and a layer composed of (a) a high silver ion conducting substance having an ion conductivity at 25°C of at least $1 \times 10^{-3}$ $(\Omega cm)^{-1}$, such as silver iodide tungstate, or a mixture of the high silver ion conducting substance with silver, and (b) a weak reducing agent. In order to increase the sensitivity of the material, a photosensitive silver halide can further be incorporated in the layer. The photographic material is exposed imagewise, and then heated for a short time to form a permanent visible image of clear contrast.

11 Claims, No Drawings

THERMODEVELOPABLE PHOTOGRAPHIC MATERIAL CONTAINING HIGH SILVER ION CONDUCTING SUBSTANCE

BACKGROUND OF THE INVENTION

1. Field of the Invention

This invention relates to a thermodevelopable photographic material, and especially to a thermodevelopable photographic material containing a high silverion conducting material having an ion conductivity at 25°C of at least $1 \times 10^{-3}$ $(\Omega cm)^{-1}$.

2. Description of the Prior Art

The photographic materials which have previously been utilized include those bases on silver halides. When exposed to a light image for a long time, some of them undergo visible darkening. Recently, U.S. Pat. Nos. Re 26,719 and 3,457,075, for example, disclose a thermodevelopable photographic material consisting of a sheet and coatings of an organic silver salt, a catalytic amount of a light-reducible silver halide, and a weak reducing agent. According to the techniques disclosed in these prior art references, when the photographic material is exposed, no visible image is formed, but when the exposed photographic material is heated at a suitable high temperature for a short period of time, a permanent visible image is formed in the exposed area.

SUMMARY OF THE INVENTION

According to this invention, there is provided a thermodevelopable photographic material containing a layer prepared by sufficiently dispersing a fine powder of a high silver ion conducting substance having an ion conductivity at 25°C of at least $1 \times 10^{-3}$ $(\Omega cm)^{-1}$ in a binder such as gelatin together with a weak reducing agent.

DETAILED DESCRIPTION OF THE INVENTION

Silver ion conducting substances having an ion conductivity of less than $1 \times 10^{-3}$ $(\Omega cm)^{-1}$ are not suitable because of poor sensitivity to radiation.

Examples of high silver ion conducting substances useful in this invention are:

1. silver iodide phosphate ($Ag_7I_4PO_4$),
2. silver iodide tungstate ($Ag_6I_4WO_4$),
3. high silver ion conducting substances composed of silver iodide and tetraalkylammonium iodides, and
4. high silver ion conducting substances composed of silver iodide and polymethonium iodide.

A specific example of the compounds of silver iodide and a tetraalkylammonium iodide described above is silver tetramethylammonium iodide, $[(CH_3)_4N]_2Ag_{13}I_{15}$. Other tetraalkylammonium iodides such as the ethyltrimethylammonium, diethyldimethylammonium, trimethylisopropylammonium, trimethylpropylammonium, tetraethylammonium, diethylmethylisopropylammonium, triethylpropylammonium, butyldiethylmethylammonium, etc., iodides with silver iodide are also suitable. Examples of the polymethonium iodides which are suitable with the silver iodide are methane-1,1-bis-methyldiethylammonium iodide, ethane-1,2-bis-trimethylammonium iodide, propane-1,3-bis-trimethylammonium iodide, butane-1,4-bis-trimethylammonium iodide, pentane-1,5-bis-trimethylammonium iodide, hexane-1,6-bis-trimethylammonium iodide, etc.

These double salts have a metal ion conductivity at room temperature of at least $1 \times 10^{-3}$ $(\Omega cm)^{-1}$. Furthermore, the same kind of metal, that is silver, can be incorporated in excess into some of the high silver ion conducting substances [see Tadashi Ohachi, *Kotai Butsuri*, 7, (1972) 340], and as a result, the sensitivity of the high silver ion conducting substances to radiation can be further increased. A suitable amount of the silver to be incorporated about 0.1 to 3 mole %, preferably 0.5 to 1 mole %, to the high silver ion conducting substance.

The reducing agent which can be used in this invention is selected depending on the high silver ion conducting substance used. Examples of suitable reducing agents are substituted phenols, substituted or unsubstituted bisphenols, substituted or unsubstituted naphthols, di- or poly-hydroxybenzenes, di- or polyhydroxynaphthalenes, hydroquinone monoethers, ascorbic acid or its derivatives, 3-pyrazolidones, pyrazoline-5-ones, reducing saccharides, kojic acid, and hinokitiol. Especially effective weak reducing agents are thiourazole derivatives such as dithiourazole hydrazine salt.

Specific examples of weak reducing agents effective for the performance of the present invention are hydroquinone, methylhydroquinone, chlorohydroquinone, bormohydroquinone, phenyl hydroquinone, hydroquinone monosulfonic acid salt, t-octyl hydroquinone, t-butylhydroquinone, 2,5-dimethyl hydroquinone, 2,6-dimethyl hydroquinone, methoxy hydroquinone, ethoxy hydroquinone, p-methoxy phenol, p-ethoxy phenol, hydroquinone monobenzyl ether, catechol, pyrogallol, resorcinol, p-aminophenol, o-aminophenol, N-methyl-p-aminophenol, 2-methoxy-4-aminophenol, 2,4-diaminophenol, 2-$\beta$-hydroxyethyl-4-aminophenol, p-t-butyl phenol, p-t-amyl phenol, p-cresol, 2,6-di-t-butyl-p-cresol, p-acetophenol, p-phenol phenol, o-phenyl phenol, 1,4-dimethoxy phenol, 3,4-xylenol, 2,4-xylenol, 2,6-dimethoxy phenol, sodium 1-amino-2-naphthol-6-sulfonate, 1-naphthylamine-7-sulfonic acid, 1-hydroxy-4-methoxy-naphthalene, 1-hydroxy-4-ethoxy-naphthalene, 1,4-dihydroxynaphthalene, 1,3-dihydroxynaphthalene, 1-hydroxy-4-aminonaphthalene, 1,5-dihydroxynaphthalene, 1-hydroxy-2-phenyl-4-methoxynaphthalene, 1-hydroxy-2-methyl-4-methoxynaphthalene, $\alpha$-naphthol, $\beta$-naphthol, 1,1'-dihydroxy-2,2'-binaphthyl, 4,4'-dimethoxy-1,1'-dihydroxy-2,2'-binaphthyl, 6,6'-dinitro-2,2'-dihydroxy-1,1'-binaphthyl, bis(2-hydroxy-1-naphthyl)methane, bisphenol A, 1,1'-bis-(2-hydroxy-3,5-dimethylphenyl)-3,5,5-trimethylhexanone, 2,4,4-trimethylpentyl-bis-(2-hydroxy-3,5-dimethylphenyl)methane, bis(2-hydroxy-3-t-butyl-5-methylphenyl)methane, bis(2-hydroxy-3,5-di-t-butylphenyl)methane, 4,4-methylenebis(3-methyl-5-t-butylphenol), 4,4'-methylenebis(2,6-di-t-butylphenol), 2,2'-methylenebis (2-t-butyl-4-ethylphenol), 2,6-bis(2-hydroxy-3-t-butyl-5-methylphenylmethyl)4-methylphenol, 3,3',5,5'-tetra-t-butyl-4,4'-dihydroxybiphenyl, l-ascorbic acid, l-ascorbic acid monoester, l-ascorbic acid diester, p-oxyphenyl glycin, N,N-diethyl-p-phenylene diamine, furion, benzoin, dihydroxyacetone, glycerine aldehyde, rhodizonic acid-tetrahydroxyquinone, methyl gallate, propyl gallate, hydroxytetronic acid, N,N-di(2-ethoxy-ethyl) hydroxylamine, glucose, lactose, 1-phenyl-3-pyrazolidone, 4-methyl-4-hydroxy-methyl-1-phenyl-3-pyrazolidone, bis(3-methyl-4-hydroxy-5-t-butylphenyl)-sulfide, 3,5-di-t-butyl-4-hydroxybenzyl-dimethylamine, $\alpha,\alpha'$-(3,5-di-t-butyl-4-hydroxyphenyl)-dimethyl ether. These weak reducing agents can be used alone or in a combination of two or more. Suitable reducing agents are selected depending on the combination thereof with the high metal ion conducting substances.

The weak reducing agent can be incorporated uniformly in a binder such as gelatin, polyvinyl alcohol or polyvinyl butyral together with the high silver ion conducting substance and coated on a support conventionally used in the photographic art, for example, a glass sheet, a baryta paper, a polyethylene terephthalate film, a cellulose triacetate film, etc. Alternatively, the high silver ion conducting substance and a light reducible silver helide or a substance which forms a photographic silver halide by reaction with the high silver ion conducting substance can be coated on a support and dried, and then the material is immersed in a solution containing the slow reducing agent. A suitable amount of the reducing agent is from $10^{-4}$ to $10^{-6}$% by weight, preferably $10^{-5}$% by weight, and of the silver ion conducting substance is from 1 to 50% by weight, preferably 10% by weight.

On the other hand, the thermodevelopable photographic material of this invention can further contain a photographic silver halide or a substance which forms a photographic silver halide by reaction with the high silver ion conducting substance to render the photographic material more sensitive. Examples of such silver halides are suitably silver iodide, silver iodobromide, silver bromide, silver chlorobromide, silver chloride, silver chloroiodide, and silver chlorobromoiodide.

The photographic silver halide can be used in the form of coarse particles or fine particles, but silver halide emulsions in the form of very fine grains, e.g., a grain size of about 0.5 $\mu$ to 10 $\mu$, are especially useful.

Examples of the compounds which form a silver halide by reaction with the high silver ion conducting substances are inorganic halogen compounds of the general formula $MX_n$ wherein M is a hydrogen atom, an ammonium group or a metal atom (for example, strontium, cadmium, zinc, tin, chromium, sodium, barium, iron, cesium, lanthanum, copper, calcium, nickel, magnesium, potassium, aluminum, antimony, gold, cobalt, mercury, lead, beryllium, lithium, manganese, gallium, indium, rhodium, ruthenium, palladium, iridium, platinum, thallium, and bismuth), X is a halogen atom (chlorine, bromine), and $n$ is 1 when M is a hydrogen atom or an ammonium group, and when M is a metal atom, $n$ represents the valency of the metal, and organic halogan compounds such as triphenylmethyl chloride, triphenylmethyl bromide, 2-bromo-2-methylpropane, 2-bromobutyric acid, 2-bromoethanol, benzophenol dichloride, bromoform, and carbon tetrabromide.

It is preferred that such a silver halide or silver halide-forming substance be in contact with the high silver ion conducting substance, and it can be incorporated into the photographic layer in the same way as in the case of the weak reducing agent. The components employed in this invention can be simply mixed with the binder and coated on a support using well known techniques.

The thermodevelopable photographic material of this invention can be sensitized using sensitizing dyes which are employed in the spectral sensitization of silver halide photographic emulsions. Examples of such dyes are cyanine dyes, thiocyanine dyes, oxonal dyes, merocyanine dyes, hemicyanine dyes., etc., as disclosed, for example, in U.S. Pat. Nos. 2,131,742, 2,172,191 and 2,132,169. But when the photographic material is exposed to ultraviolet rays, such a dye can be omitted. Some of the above-cited high silver ion conducting substances do not have attractive white colors, and in order to render the color whiter, a small amount, e.g., in an amount of 0.1 to 1% by weight, of a white pigment powder such as zinc oxide or titanium dioxide can be added together with the high silver ion conducting substance.

The amounts of the various ingredients described above are determined depending on the reducibility, catalyzablility, molecular weight, etc. of the compounds to be used. Generally, however, the amount of the weak reducing agent is 0.002 to 0.5 part by weight, preferably 0.01 to 0.05 part by weight, per part by weight of the high silver ion conducting substance. The amount of the silver halide or silver halide-forming substance is 0.0002 to 0.01 part by weight, preferably 0.001 to 0.005 part by weight, per part of the high silver ion conducting substance. The amount of the binder is from 10 to 90% by weight, preferably 30 to 50% by weight of the total composition.

By coating these ingredients on a support, the thermodevelopable photographic material of this invention can be obtained.

The method of using the photographic material of this invention will be described. First, the photographic material is exposed imagewise, and then heated with a suitable heating means, for example, by passing the photographic material between heated rolls or bringing it into contact with a heated plate. This heating results in the blackening of the exposed area to form an image. The image so developed by heating usually does not undergo any further development, but remains as a permanent image.

The exposure conditions vary considerably over a wide range since they depend on the type and intensity of the light or irradiation source, the developing condition, the reducing agent and the additives used. A suitable exposure is to a wavelengths of light ranging from 300 m$\mu$ to 800 m$\mu$ for about 0.5 to 50 seconds. For example, when the light from a tungsten-filament lamp with an illuminance of 50 luxes is used, the preferred exposure time is 1 to 10 seconds. Preferably, the development is performed by heating the photographic material at 75° to 160°C for 1 to 10 seconds.

The photographic material in accordance with this invention can be developed by the dry method after exposure, and a stable image can be obtained without going through fixation and other steps. Accordingly, it is possible to provide a rapid and simplified copying process and also to simplify the treating equipment.

Furthermore, the photographic material of this invention permits freedom from handling liquid chemicals for development and fixation, and involves no risk of contaminating the hands and garments of the working personnel during the handling of the photographic material. In addition, no waste or spent liquor is formed, and therefore, there is no risk of environmental pollution. Thus, the advantages obtained by this invention are great.

The following Examples illustrate the present invention in greater detail. Unless otherwise indicated, all parts, percents, ratios and the like are by weight.

EXAMPLE 1

Silver iodide tungstate (3 g) prepared in the dark and finely pulverized (average particle size 0.5 $\mu$ to 5 $\mu$) was thoroughly dispersed in a binder consisting of 50 cc of water and 3 g of gelatin. The resulting dispersion was coated on a dry glass plate, and dried. The coated plate was immersed in a 0.1 F aqueous solution of dithiourazole hydrazine salt, and dried. During the above and subsequent operations, the plate is maintained completely in the dark. A part of the plate is exposed imagewise for 1 second using tungsten-filament lamp of 60 luxes, and then heated at 80°C. for 5 seconds. There was obtained a visible image which conformed to the shape of the image area and had a dark black color with a high resolution on a cream colored background.

EXAMPLE 2

Silver iodide tungstate (3 g) prepared in the dark and finely pulverized (average particle size 0.5 $\mu$ to 5 $\mu$) was thoroughly dispersed in a binder consisting of 50 cc of water and 3 g of gelatin, and a very small amount (about 10 -6% by weight) of 3-carboxymethyl-5(3e-thoxycarbonylmethyl-2-(3H)-thiazolynylidene) ethylidene]-rhodanine as a sensitizing dye was added. The resulting dispersion was coated on a dry glass plate and dried. The coated plate was immersed in a 0.1F aqueous solution of dithiourazole hydrazine salt. During the above and subsequent operations, the plate was maintained completely in the dark. A part of the plate was exposed imagewise for 1 second using a tungsten-filament lamp of 60 luxes, and then heated at 80°C for 5 seconds. There was obtained a visible image which conformed to the shape of the image area and had a dark black color with a high resolution on a cream colored background. The image area was darker than in Example 1.

EXAMPLE 3

Silver iodide phosphate (3 g) prepared in the dark and finely pulverized (average particle size 0.5 $\mu$ to 5 $\mu$) was thoroughly dispersed in a binder consisting of 50 cc of water and 3 g of gelatin, and then the resulting dispersion was coated on a dry glass plate and dried. The coated plate was immersed in a 0.1F aqueous solution of dithiourazole hydrazine salt, and dried. During the above and subsequent operations, the plate was maintained completely in the dark. A part of the plate was exposed image-wise for 1 second using a tungsten-filament lamp of 60 luxes, and heated at 90°C. for 5 seconds. There was obtained a visible image which conformed to the shape of the image area and had a dark black color with a high resolution on a somewhat orange colored background.

EXAMPLE 4

Silver iodide tungstate prepared in the dark and finely pulverized (average particle size 0.5 $\mu$ to 5 $\mu$) was well dispersed in 100 cc of isopropyl alcohol containing 2 g of polyvinyl butyral. The dispersion was coated on a dry glass plate, and dried. The coated plate was immersed in a 0.1F aqueous solution of p-methoxyphenol, and dried. During the above and subsequent operations, the plate was maintained completely in the dark. A part of the plate was exposed imagewise for 5 seconds using a tungsten-filament lamp of 60 luxes, and then heated at 120°C for 5 seconds. There was obtained a visible image which conformed to the shape of the image area and had a dark black color with a high resolution on a cream colored background.

EXAMPLE 5

Silver iodide tungstate (3 g) (average particle size 0.5 $\mu$ to 5 $\mu$) prepared in the dark was mixed with 0.03 g of fine grains of silver (average particle size 0.1 $\mu$ to 0.5 $\mu$), and the mixture was melted at 220°C for 5 hours. The mixture was finely pulverized, and well dispersed in a binder consisting of 50 cc of water and 3 g of gelatin. The resulting dispersion was coated on a dry glass plate, and dried. The coated plate was immersed in a 0.1F aqueous solution of dithiourazole hydrazine salt. During the above and subsequent operations, the plate was maintained completely in the dark. A part of the plate was exposed imagewise for 1 second using a tungsten-filament lamp of 60 luxes and then heated at 80°C for 5 seconds. There was obtained a visible image which had a dark color with a high resolution on a cream colored background.

EXAMPLE 6

Finely pulverized silver iodide tungstate (3 g) (average particle size 0.5 $\mu$ to 5 $\mu$) was well dispersed in a binder consisting of 50 cc of water and 3 g of gelatin, and 0.1 g of potassium chloride was added, followed by good stirring. The resulting dispersion was coated on a dry glass plate, and dried. The coated plate was immersed in a 0.1 F aqueous solution of dithiourazole hydrazine salt and then dried. During the above and subsequent operations, the plate was maintained completely in the dark. A part of the plate was exposed imagewise for 1 second using a tungsten-filament lamp of 60 luxes, and then heated at 80°C for 5 seconds. There was obtained a visible image which has a dark color with a high resolution on a cream colored background.

EXAMPLE 7

Finely divided silver iodide tungstate (3 g) (average particle size about 0.5 $\mu$ to 2 $\mu$) was thoroughly dispersed in a binder consisting of 50 cc of water and 3 g of gelatin, and 0.1 g of potassium bromide was added, followed by thorough stirring and then adding a very small amount (about $10^{-6}$ wt%) of 3-carboxymethyl-5-[(3-ethoxycarbonylmethyl-2(3H)-thiazolynylidene) ethylidene]-rhodanine as a sensitizing dye. The resulting dispersion was coated on a dry glass plate, and dried. The coated plate was immersed in a 0.1F aqueous solution of dithiourazole hydrazine salt, and dried. During the above and subsequent operations, the plate was maintained completely in the dark. A part of the plate was exposed imagewise for 1 second using a tungsten-filament lamp of 60 luxes, and then heated at 80°C for 5 seconds. There was obtained a visible image which had a dark black color with a high resolution on a cream colored background. The density of the image area was darker than that of the copy obtained in Example 6.

EXAMPLE 8

Finely pulverized silver iodide phosphate (3 g) (average particle size about 0.5 $\mu$ to 2 $\mu$) was thoroughly dispersed in a binder consisting of 50 cc of water and 3 g of gelatin, and 0.1 g of potassium bromide was added. The resulting dispersion was coated on a dry glass plate, and dried. The coated plate was immersed in a 0.1 F aqueous solution of dithiourazole hydrazine salt, and dried. During the above and subsequent operations, the plate was maintained completely in the dark.

A part of the plate was exposed imagewise for 1 second using a tungsten-filament lamp of 60 luxes, and heated at 90°C for 5 seconds. There was obtained a visible image which had a dark black color with a high resolution on a somewhat orange colored background.

EXAMPLE 9

Finely pulverized silver iodide tungstate (3 g) (average particle size about 0.5 $\mu$ to 2 $\mu$) was dispersed in 100 cc of isopropyl alcohol containing 2 g of polyvinyl butyral, and 0.1 g of potassium bromide, followed by good stirring. The resulting suspension was coated on a polyethylene film, and dried. The coated film was immersed in a 0.1F aqueous solution of p-methoxyphenol, and dried. During the above and subsequent operations, the film was maintained completely in the dark. A part of the film was exposed imagewise for 5 seconds using a tungsten-filament lamp of 60 luxes, and then heated at 120°C for 5 seconds. There was obtained a visible image which had a dark color with a high resolution on a cream colored background.

EXAMPLE 10

Silver iodide tungstate (3 g) (average particle size 0.5 $\mu$ to 5 $\mu$) was mixed with 0.03 g of fine grains of silver (average particle size about 0.1 $\mu$ to 0.5 $\mu$), and the mixture was melted at 220°C for 5 hours. The mixture was pulverized and dispersed well in a binder consisting of 50 cc of water and 3 g of gelatin, and 0.1 g of potassium bromide was added. The resulting dispersion was coated on a dry glass plate, and dried. The coated plate was immersed in a 0.1F aqueous solution of dithiourazole hydrazine salt, and dried. During the above and subsequent operations, the plate was maintained completely in the dark. A part of the plate was exposed imagewise for 1 second using a tungsten-filament lamp of 60 luxes for 1 second, and then heated at 80°C for 5 seconds. There was obtained a visible image which had a dark black color with a high resolution on a cream colored background. The density of the image area was darker than that of the copy obtained in Example 6.

While the invention has been described in detail and with reference to specific embodiments thereof, it will be apparent to one skilled in the art that various changes and modifications can be made therein without departing from the spirit and scope thereof.

What is claimed is:

1. A thermodevelopable photographic material comprising a support having thereon a layer composed of (a) a high silver ion conducting substance having an ion conductivity at 25°C of at least $1 \times 10^{-3}$ $(\Omega\ cm)^{-1}$ or a mixture of said high silver ion conducting substance with silver, and (b) a weak reducing agent, said high silver ion conducting substance being selected from the group consisting of silver iodide phosphate, silver iodide tungstate, a double salt of silver iodide and a tetra alkylammonium iodide, and a double salt of silver iodide and a polymethonium iodide.

2. A thermodevelopable photographic material comprising a support and a layer composed of (a) a high silver ion conducting substance having an ion conductivity at 25°C of at least $1 \times 10^{-3}$ $(\Omega\ cm)^{-1}$ or a mixture of said high silver ion conducting substance with silver, (b) a weak reducing agent, and (c) a photosensitive silver halide or a compound capable of forming a photosensitive silver halide by reaction with the component (a), said high silver ion conducting substance being selected from the group consisting of silver iodide phosphate, silver iodide tungstate, a double salt of silver iodide and a tetraalkylammonium iodide, and a double salt of silver iodide and a polymethonium iodide.

3. The photographic material of claim 1, wherein the amount of said silver with said silver ion conductive substance is 0.002 to 0.1 part by weight per part by weight of said silver ion conducting substance.

4. The photographic material of claim 1, wherein said weak reducing agent is selected from the group consisting of substituted phenols, substituted or unsubstituted bisphenols, substituted or unsubstituted naphthols, di- and poly-hydroxybenzenes, di- and poly-hydroxynaphthalenes, hydroquinone monoethers, ascorbic acid and its derivatives, 3-pyrazolidones, pyrazoline-5-ones, reducing saccharides, kojic acid, hinokitiol, and thiourazole derivatives.

5. The photographic material of claim 1, wherein said layer further contains a white pigment.

6. The photographic material of claim 1, wherein the amount of said weak reducing agent (b) is 0.002 to 0.5 part by weight per part of said silver ion conducting substance.

7. The photographic material of Claim 2, wherein the amount of said component (c) is 0.0002 to 0.01 part by weight per part by weight of said silver ion conducting substance.

8. The photographic material of claim 2, wherein the amount of said silver with said silver ion conducting substance is 0.002 to 0.1 part by weight per part by weight of said silver conducting substance.

9. The photographic material of claim 2, wherein said weak reducing agent is selected from the group consisting of substituted phenols, substituted or unsubstituted bisphenols, substituted or unsubstituted naphthols, di- and poly-hydroxybenzenes, di- and poly-hydroxynaphthalenes, hydroquinone monoethers, ascorbic acid and its derivatives, 3-pyrazolidones, pyrazoline-5-ones, reducing saccharides, kojic acid, hinokitiol, and thiourazole derivatives.

10. The photographic material of claim 2, wherein said layer further contains a white pigment.

11. The photographic material of claim 2, wherein the amount of said weak reducing agent (b) is 0.002 to 0.5 part by weight per part of said silver ion conducting substance.

* * * * *